US005390736A

United States Patent [19]

Budde

[11] Patent Number: 5,390,736

[45] Date of Patent: Feb. 21, 1995

[54] ANTI-ROTATION DEVICES FOR USE WITH WELL TOOLS

[75] Inventor: Peter Budde, Chevreuse, France

[73] Assignee: Weatherford/Lamb, Inc., Houston, Tex.

[21] Appl. No.: 79,614

[22] Filed: Jun. 21, 1993

[30] Foreign Application Priority Data

Dec. 22, 1992 [NL] Netherlands ..... 9202234
Apr. 26, 1993 [GB] United Kingdom ..... 9308594

[51] Int. Cl.[6] ..... E21B 33/16

[52] U.S. Cl. ..... 166/153; 166/156; 166/192

[58] Field of Search ..... 166/153, 1, 156, 192, 166/193, 194, 291

[56] References Cited

U.S. PATENT DOCUMENTS

| | | | |
|---|---|---|---|
| Re. 33,656 | 8/1991 | Wardlaw, III et al. | 166/153 |
| 1,872,855 | 8/1932 | Walker | 166/153 |
| 2,165,433 | 7/1939 | Wickersham | 166/153 |
| 2,169,568 | 8/1939 | Morrisett | 166/1 |
| 2,196,652 | 4/1940 | Baker | 166/1 |
| 2,201,299 | 5/1940 | Owsley et al. | 166/1 |
| 2,662,600 | 12/1953 | Baker et al. | 166/1 |
| 2,717,645 | 9/1955 | Schnitter | 166/156 |
| 2,740,480 | 4/1956 | Cox | 166/170 |
| 2,854,079 | 9/1958 | Schnitter | 166/70 |
| 3,006,415 | 10/1961 | Burns et al. . | |
| 3,145,778 | 8/1964 | Greket et al. | 166/157 |
| 3,507,325 | 4/1970 | Scott | 166/5 |
| 3,550,683 | 12/1970 | Comeaux | 166/156 |
| 3,635,288 | 1/1972 | Lebourg | 166/156 |
| 3,768,556 | 10/1973 | Baker | 166/154 |
| 3,835,889 | 9/1974 | Hyde | 138/93 |
| 3,842,905 | 10/1974 | Morrisett et al. | 166/155 |
| 3,971,436 | 7/1976 | Lee | 166/70 |
| 4,078,810 | 3/1978 | Arendt | 166/153 X |
| 4,083,074 | 4/1978 | Curtis | 15/104.06 R |
| 4,171,019 | 10/1979 | Cole | 166/341 |
| 4,175,619 | 11/1979 | Davis | 166/153 X |
| 4,190,111 | 2/1980 | Davis | 166/153 X |
| 4,190,112 | 2/1980 | Davis | 166/153 X |
| 4,248,299 | 2/1981 | Roeder | 166/153 |
| 4,262,702 | 4/1981 | Streich | 138/89 |
| 4,356,865 | 11/1982 | Appel et al. | 166/153 |
| 4,378,838 | 4/1983 | Ogden et al. | 166/153 |
| 4,429,746 | 2/1984 | Allard | 166/291 |
| 4,436,151 | 3/1984 | Callihan et al. | 166/154 |
| 4,706,747 | 11/1987 | Schneider | 166/153 |
| 4,771,675 | 9/1988 | Grauer et al. | 92/242 |
| 4,836,279 | 6/1989 | Freeman | 166/153 |
| 4,858,687 | 8/1989 | Watson et al. | 166/153 |
| 4,979,562 | 12/1990 | Langer | 166/242 |
| 5,004,048 | 4/1991 | Bode | 166/70 |
| 5,025,858 | 6/1991 | Glaser | 1669/156 |
| 5,095,980 | 5/1992 | Watson | 166/192 |
| 5,234,052 | 8/1993 | Coone et al. | 166/156 X |
| 5,242,018 | 9/1993 | LaFleur | 166/155 |

FOREIGN PATENT DOCUMENTS

| | | |
|---|---|---|
| 86309145.0 | 11/1985 | European Pat. Off. . |
| 87307810.9 | 9/1986 | European Pat. Off. . |
| 9008139 | 6/1990 | France . |
| PCT/EP89/-01219 | 10/1988 | WIPO . |

OTHER PUBLICATIONS

"Pipeline Pigging Products," Pipeline Pigging Products, Incorporated, 1989.

"Conventional and Specialized Float Equipment," Weatherford International Incorporated, 1955.

"1988–89 General Services and Products Catalog," Weatherford International Incorporated, 1987.

"Weatherford General Catalog, 1992–1993," Weatherford International Incorporated, 1992.

"Positive Seal/Positive Drill Float & Plug System," McAllister Petroleum Services, 1987.

"Sales & Service Catalog 43," Halliburton Services, 1986.

"Oil Well Cementing Practices In The United States," American Petroleum Institute, 1959, p. 112.

*Primary Examiner*—William P. Neuder
*Attorney, Agent, or Firm*—Guy McClung

[57] ABSTRACT

An anti-rotation device for use in a well tool, for example a top plug or a bottom plug, has a tapered male member having a corrugated outer surface which can enter a corresponding recess in another well tool to inhibit relative rotation therebetween.

17 Claims, 3 Drawing Sheets

FIG. 3
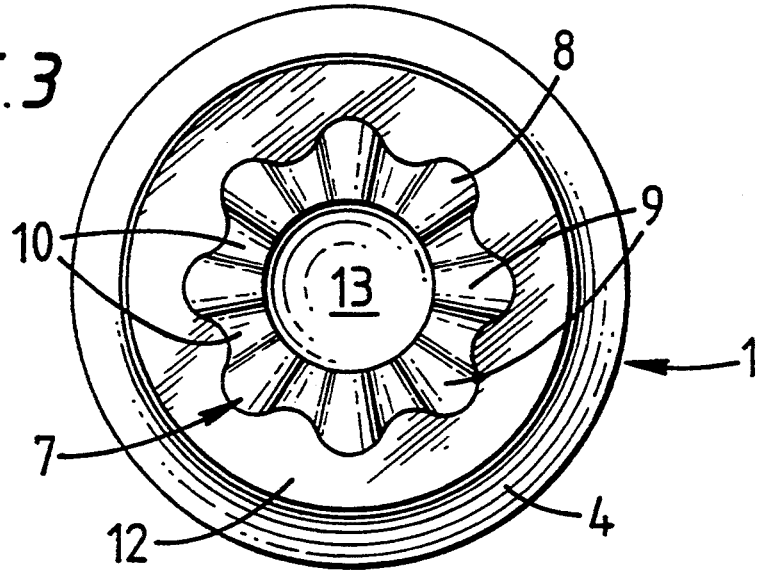
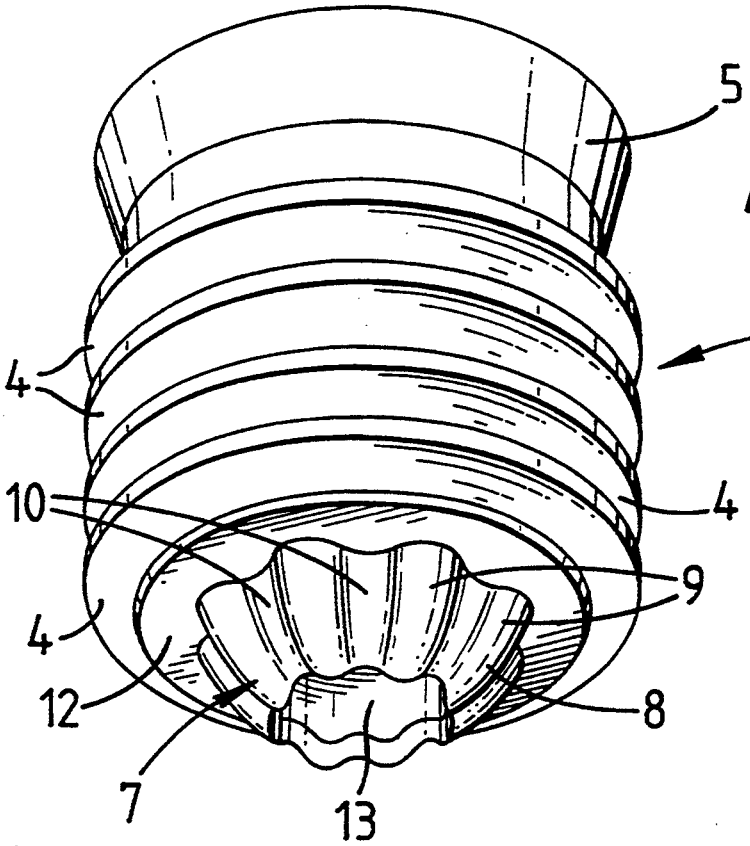
FIG. 4

ANTI-ROTATION DEVICES FOR USE WITH WELL TOOLS

FIELD OF THE INVENTION

This invention relates to anti-rotation devices for use with well tools and, more particularly, but not exclusively, is concerned with anti-rotation devices for plugs, float collars and float shoes. The present invention also relates to well tools provided with said anti-rotation devices.

BACKGROUND OF THE INVENTION

During cementation, plugs are lowered into a well bore. Once the cementation operation is completed these plugs, together with the associated float collar and/or float shoe are drilled out.

One of the difficulties in drilling out plugs is that they can rotate with the drill thereby seriously delaying progress.

Various proposals have been made for inhibiting the rotation of plugs in the well bore during drilling out. Typically, these comprise providing the plug and/or the float collar/shoe with anti-rotation devices which are intended to inhibit rotation of the plug relative to the float collar/shoe which is non-rotatably set in the casing.

Early anti-rotation devices included protrusions which had the disadvantage that the full weight of the drill string was applied to the protrusions via the plug with the result that the protrusions often broke under the axial load and were rendered largely ineffective.

Applicants WO-91/17340 discloses an anti-rotation device in which the axial load is carried by circular load bearing seals mounted on the upper surface of the float collar and the lower surface of the plug and both the plug and the float collar are provided with teeth which inter-engage but are not subject to any axial load. As a result, the teeth are used solely to transmit rotational forces.

Whilst this arrangement works generally acceptably it has a disadvantage that in deviated wells the protrusion on, for example the plug may land on the load bearing member of the float collar rather than inter-engaging the teeth thereof. On attempted rotation of the plug these protrusions may then be broken off.

SUMMARY OF THE INVENTION

The present invention aims to provide an anti-rotation device which can be used for both straight and deviated wells.

According to one aspect of the present invention there is provided an anti-rotation device for use in a well tool, said anti-rotation device comprising a tapered male member having a corrugated outer surface.

Advantageously, said anti-rotation includes a load bearing surface circumjacent said tapered male member.

Preferably, said load bearing surface is also a sealing surface.

Preferably, said well tool is a plug and said anti-rotation device is attached to or formed as an integral part of said plug.

Advantageously, said corrugations extend generally parallel to the longitudinal axis of said plug.

Preferably, said corrugations comprise mounds and recesses which, when viewed in cross-section in a plane perpendicular to the longitudinal axis of said plug, are bound by semi-circles.

Advantageously, said corrugations comprise mounds and recesses and the outer extremity of said mounds lie on an imaginary sphere having its centre substantially on the longitudinal axis of said plug.

Preferably, said corrugations comprise mounds and recesses and the inner extremity of said recesses lie on an imaginary sphere having its centre substantially on the longitudinal axis of said plug.

Advantageously, the centres of said imaginary spheres are displaced from one another along the longitudinal axis of said plug.

The present invention also provides an anti-rotation device for use in a well tool, said anti-rotation device comprising a female socket having a corrugated surface complementary to the corrugated outer surface of the tapered male member of the aforedescribed anti-rotation device in accordance with the invention.

Preferably, said anti-rotation device includes a load bearing surface circumjacent said female socket.

Advantageously, said load bearing surface is also a sealing surface.

Whilst it is preferred that a well tool such as a float shoe or a float collar be provided with a female socket and the bottom of a plug with a tapered male member it is also possible for the float shoe or float collar to be provided with an upwardly tapered male member and the bottom of the plug with a female socket. However, the former arrangement is much preferred as any debris is directed downwardly through the float collar whilst an upwardly tapered male member would direct the debris onto the upwardly facing surface of the float collar/shoe circumjacent the upwardly tapered member.

Preferably, said anti-rotation device comprises a load bearing surface circumjacent said female socket.

Advantageously, said load bearing surface is also a sealing surface.

Preferably, the projection of a tapered male member beyond its load bearing surface is less than the depth of the female socket so that when the tapered male member is fully inserted in the female socket substantially all axial load is transmitted via said load bearing surfaces.

For a better understanding of the invention reference will now be made, by way of example, to the accompanying drawings, in which:

BRIEF DESCRIPTION OF THE DRAWINGS

FIG. 3 is a view taken on line III—III of FIG. 1;

FIG. 4 is a perspective view taken in the direction of arrow IV in FIG. 1.

DETAILED DESCRIPTION OF THE PREFERRED EMBODIMENT

Figure 1:
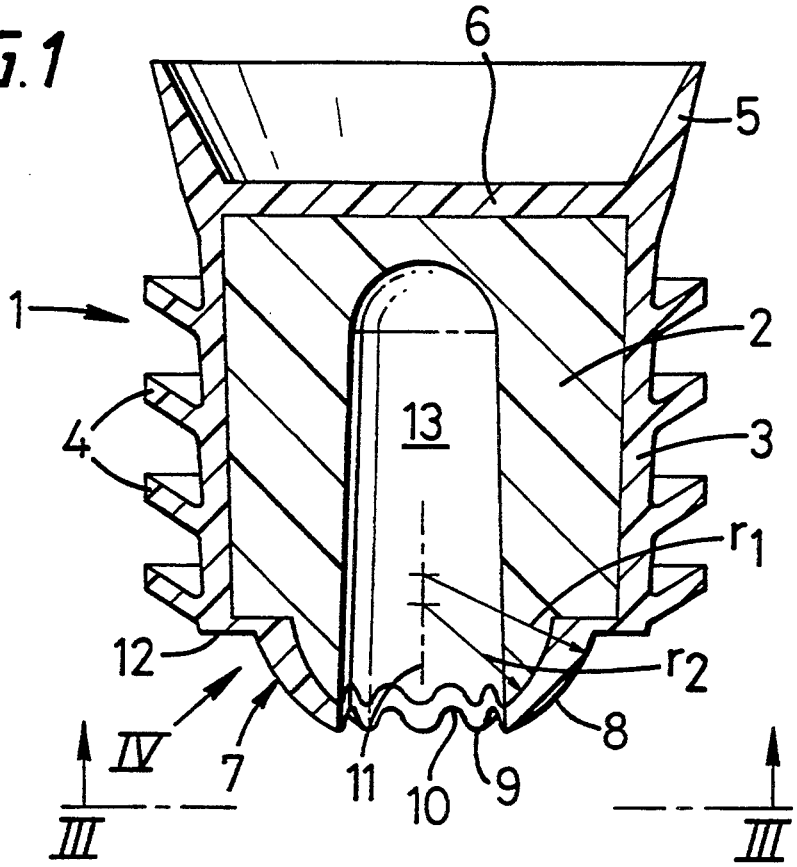
FIG. 1 is a vertical cross-section through one embodiment of a top plug in accordance with the invention.

Referring to FIG. 1 of the drawings, there is shown a top plug which is generally identified by the reference numeral 1. The plug 1 is made of plastics material and comprises a core 2 of rigid polyurethane in an outer casing 3 of elastic polyurethane. The outer casing 3 includes a plurality of wipers 4, a sealing fin 5 and a top 6.

The top plug 1 includes an anti-rotation device in the form of a tapered male member 7 which, as is more clearly shown in FIG. 4, has a corrugated outer surface 8 comprising alternate mounds 9 and recesses 10.

As shown in FIG. 1, the outer extremity of each of the mounds 9 lies on an imaginary sphere having its centre on the longitudinal axis 11 of the top plug 1 and a radius $r_1$. Similarly, the inner extremity of each of the recesses 10 lies on an imaginary sphere having its centre on the longitudinal axis 11 of the top plug 1 and a radius $r_2$.

It will be noted that $r_2$ is displaced from $r_1$ along the longitudinal axis 11 of the top plug 1.

As can be seen from FIG. 3, if a section is taken through the tapered male member 7 perpendicular to the longitudinal axis 11 of the top plug 1 the mounds 9 and recesses 10 have the outline of substantial semi-circles which flow smoothly into one another.

The tapered male member 7 is surrounded by an annular load bearing and sealing surface 12.

The core 2 is provided with a cavity 13 which reduces the overall weight of the top plug 1 and facilitates drilling out of the top plug 1 after use.

Figure 2:
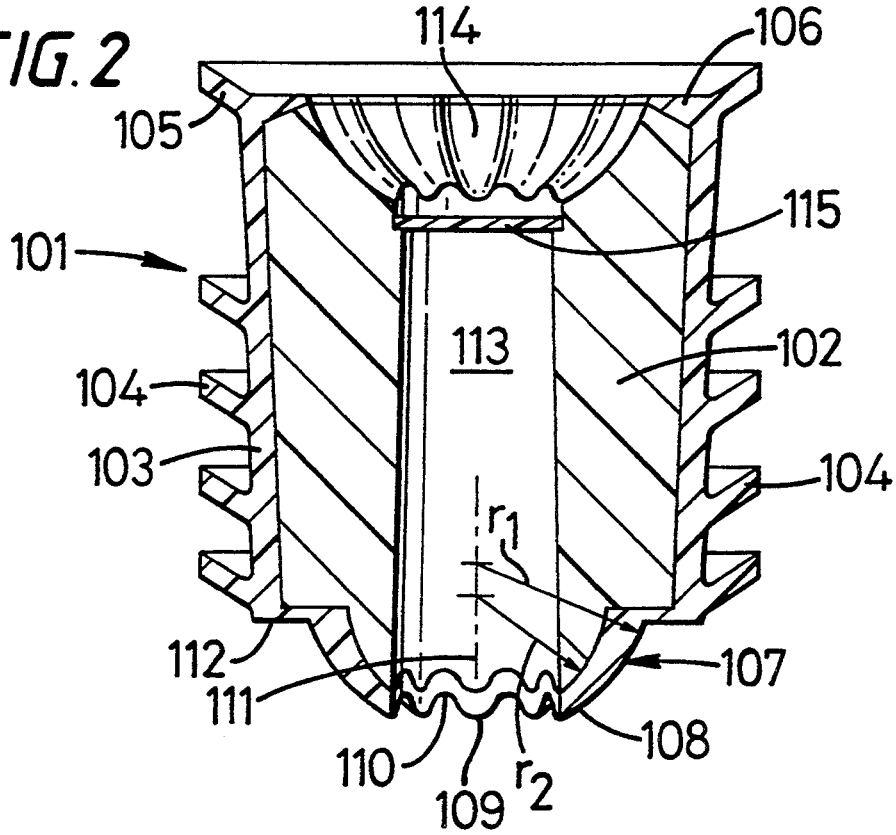
FIG. 2 is a vertical cross-section through one embodiment of a bottom plug in accordance with the invention.

Referring now to FIG. 2, the bottom plug 101 is in many respects similar the top plug 1 and parts having similar functions have been identified by similar reference numerals in the 100 series.

The bottom plug 101 differs from the top plug 1 in that the top surface 106 is provided with an anti-rotation device in the form of a female socket 114 having a shape which is complementary to the tapered male member 7.

In addition, the cavity 113 extends the full axial length of the bottom plug 101 and is provided with a removable bursting disk 115.

Figure 5:
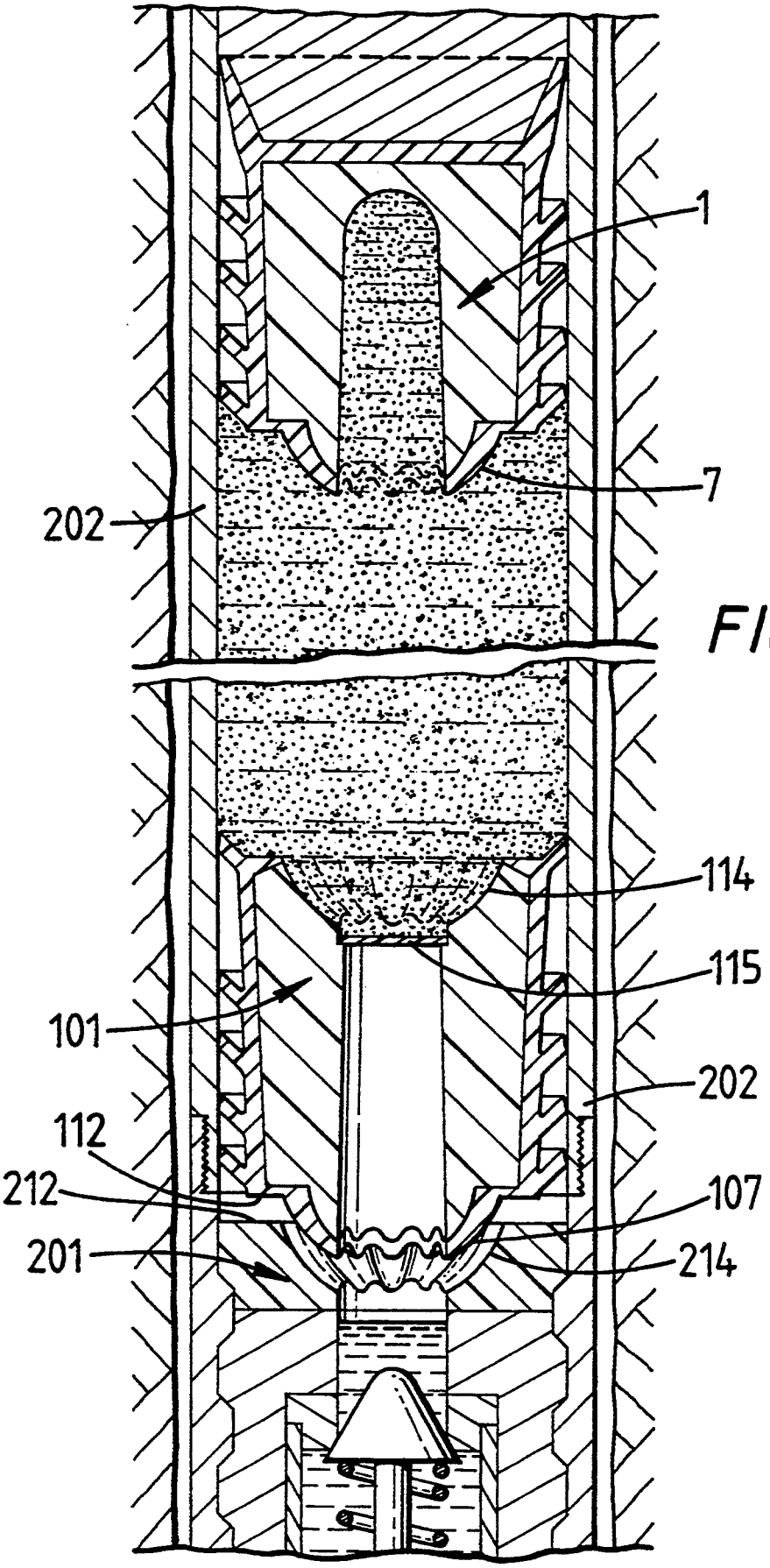
FIG. 5 is a vertical cross-section showing the top plug and bottom plug approaching a float shoe in a casing.

Turning now to FIG. 5, during the construction of a typical well a hole is first drilled to a depth of, say 1000 m. A float shoe 201 provided with a female socket 214 is secured onto the end of a string of casing 202 which is lowered to within a few meters of the bottom of the well.

The bottom plug 101 is then placed in the casing 202 and the calculated quantity of wet cement pumped onto the top of the bottom plug 101 which is slowly forced down the casing 202 by the weight of the cement and the pressure applied thereto by the pump.

FIG. 5 shows the bottom plug 101 approaching the float shoe 201. As the bottom plug 101 approaches the float shoe 201 the tapered male member 107 engages in the female socket 214 and the annular load bearing and sealing surface 112 sealingly engages a similar annular load bearing and sealing surface 212 circumjacent the female socket 214.

Once the bottom plug 101 seats on float shoe 201 the pressure of the wet cement builds up and fractures the bursting disk 115 thereby allowing the cement to pass through the float shoe 201, outwardly to the walls of the hole and upwardly between the outer wall of the casing 202 and the wall of the hole.

When the desired amount of cement has been pumped into the casing 202 the top plug 1 is placed in the casing 202. The top of the casing 202 is then closed and drilling mud is admitted to the top of the casing 202 to drive the top plug 1 and the remaining wet cement down the casing 202.

Cement continues to flow until the tapered male member 7 on the top plug 1 enters the female socket 114 on the bottom plug 101.

Hydraulic pressure may be maintained on the top plug 1 whilst the cement dries. At this stage the casing 202 is depressurised, opened and a rotating drill is lowered down the casing 202 until it engages the top plug 1.

Because the tapered male member 7 is engaged in the bottom plug 101 the top plug 1 will not rotate independently of the bottom plug 101. Similarly, since the tapered male member 107 on the bottom plug 101 is engaged in the female socket 214 in the float shoe 201 neither the top plug 1 nor the bottom plug 101 will rotate. This facilitates rapid drilling out.

The shape of the tapered male member 7 and the complimentary female socket have several advantages. In particular, the tapered male member 7 will engage the female socket 114 even though they may not be in perfect axial alignment immediately prior to engagement. This is particularly important for use in deviated wells. In addition, because the female socket 114 slopes continuously and smoothly downwardly, there is little risk of debris becoming lodged between the tapered male member and the female socket. The height of the tapered male member is slightly less than the depth of the female socket 114 so that the tapered male member 7 is not subject to axial compressive stresses. Whilst this feature is most highly recommended it is not however essential although we would recommend the provision of two or more axially extending slots in the tapered male member 7 to allow for radial compression if the tapered male member is to be subject to compressive forces.

Various modifications to the embodiments described are envisaged. For example, a float collar may be used above the float shoe. In this case the float collar would be provided with the female socket whilst this would not be necessary for the lower float shoe. If desired, the outer casing and/or the entire plug could be made from rubber. Also the tapered male member could be made as a separate part which could be mounted on the plug. Similarly, the female socket 114 could be formed in a separate disk which could be secured, for example bolted, to the top of the bottom plug. Similarly, the female socket 214 could be formed as an integral portion of the float collar or float shoe. In such an embodiment the female socket 214 could be surrounded by concrete which could optionally be covered with a layer of plastics material.

If desired, the wipers 4 and sealing fin 5 may be replaced by the wipers and sealing fins disclosed in our co-pending application number 08/079,334 of even date.

Filed on even date herewith naming the same inventor as does this application and as part hereof are copies of co-owned applications entitled "Plug" and "Anti-Rotation Devices For Use With Well Tools."

Whilst the embodiments shown in the drawings have eight mounds 9; 109 and eight recesses 10; 110, it will be appreciated that the number of mounds and recesses may be varied. Thus, whilst a plug for 9⅝" casing, as shown in the figures, may have six or eight mounds and recesses it is envisaged that plugs of smaller diameter might be provided with fewer mounds and recesses, for example four or even three mounds and recesses. Similarly, it is envisaged that larger diameter plugs might be provided with additional mounds and recesses, for example ten, twelve, fourteen or sixteen mounds and recesses. The optimum number of mounds and recesses for any plug will be determined by trial and error. Essentially, the greater the number of mounds and recesses the easier the bottom plug will engage the socket in the float collar or float shoe. However, as the number of mounds and recesses increases the ability of the interaction of the male member and socket to resist rotational stresses decreases. For general purposes plugs having six or eight mounds and recesses should be quite satisfactory.

What is claimed is:

1. An anti-rotation device for working in combination with a female tapered corrugated device for use in a well tool, said anti-rotation device comprising a tapered male member with a top and a bottom, the top wider than the bottom, the tapered male member having a tapered corrugated outer surface which tapers from the top to the bottom.

2. An anti-rotation device as claimed in claim 1 including a load bearing surface circumjacent said tapered male member.

3. An anti-rotation device as claimed in claim 2 wherein said load bearing surface is also a sealing surface.

4. A plug for use in a well bore, said plug including an anti-rotation device comprising a tapered male member with a top and a bottom, the top wider than the bottom, the tapered male member having a tapered corrugated outer surface.

5. A plug as claimed in claim 4, including a load bearing surface circumjacent said tapered male member.

6. A plug as claimed in claim 5, wherein said load bearing surface is also a sealing surface.

7. A plug as claimed in claim 4, wherein said corrugations extend generally parallel to a longitudinal axis of said plug.

8. A plug as claimed in claim 7, wherein said corrugations comprise mounds and recesses which, when viewed in cross-section in a plane perpendicular to the longitudinal axis of said plug, are bound by semi-circles.

9. A plug as claimed in claim 4, wherein said corrugations comprise mounds and recesses and outer extremities of said mounds are on an imaginary sphere having a center substantially on a longitudinal axis of said plug.

10. A plug as claimed in claim 4, wherein said corrugations comprise mounds and recesses and an inner extremity of said recesses is on an imaginary sphere having a center substantially on a longitudinal axis of said plug.

11. A plug as claimed in claim 4, wherein said corrugations comprise mounds and recesses and outer extremities of said mounds are on an imaginary sphere having a center substantially on a longitudinal axis of said plug, an inner extremity of said recesses is on an imaginary sphere having a center substantially on the longitudinal axis of said plug, and said centers of said imaginary spheres are displaced from one another along the longitudinal axis of said plug.

12. An anti-rotation device for use in a well tool, said anti-rotation device comprising a tapered female socket having a top and a bottom, the top wider than the bottom, the tapered female member having a tapered corrugated surface which tapers from the top to the bottom, the tapered female socket for working in combination with a tapered male member, the tapered corrugated surface of the tapered female socket complementary to a corrugated outer surface of the tapered male member.

13. An anti-rotation device as claimed in claim 12 including a load bearing surface circumjacent the female socket.

14. An anti-rotation device as claimed in claim 13, wherein said load bearing surface is also a sealing surface.

15. A float collar provided with an anti-rotation device as claimed in claim 1.

16. A float shoe provided with an anti-rotation device as claimed in claim 1.

17. A top plug and a bottom plug in combination, said top plug for use in a well bore, said top plug having an anti-rotation device comprising a tapered male member having a top and a bottom, the top wider than the bottom, the top plug having a tapered corrugated outer surface extending downwardly from said top plug, said top plug having a load bearing and sealing surface circumjacent said tapered male member, said bottom plug having a tapered female socket having a tapered corrugated surface complementary to the tapered corrugated outer surface of said tapered male member of said top plug, said bottom plug having a load bearing and sealing surface circumjacent said female socket, and said tapered male member projecting beyond said load bearing and sealing surface of said top plug less than the depth of said female socket, said tapered male member fully insertable in said female socket so that substantially all axial load on said top plug is transmitted to said bottom plug via said load bearing surfaces of said top plug and of said bottom plug.

* * * * *